United States Patent [19]

Glaze

[11] 4,155,288

[45] May 22, 1979

[54] CONTROL SYSTEM FOR A FLUID PRESSURE OPERATED ACTUATOR ARRANGEMENT

[75] Inventor: Stanley G. Glaze, Brierley Hill, England

[73] Assignee: Lucas Industries Limited, Birmingham, England

[21] Appl. No.: 806,614

[22] Filed: Jun. 15, 1977

[30] Foreign Application Priority Data

Jul. 10, 1976 [GB] United Kingdom ..... 28801/76

[51] Int. Cl.[2] ..... F15B 9/03; F15B 9/09; F15B 11/16; F15B 13/06

[52] U.S. Cl. ..... 91/363 A; 91/365; 91/461; 91/510; 91/534

[58] Field of Search ..... 91/363 A, 411 R, 413

[56] References Cited

U.S. PATENT DOCUMENTS

| | | | |
|---|---|---|---|
| 3,540,350 | 11/1970 | Heine | 91/363 A |
| 3,554,084 | 1/1971 | Rasmussen | 91/411 R |
| 3,826,174 | 7/1974 | Platt | 91/363 A |

*Primary Examiner*—Paul E. Maslousky

[57] ABSTRACT

A control system for a fluid powered actuator arrangement which includes two drivingly interconnected hydraulic actuator devices, comprises two control valves which are movable in unison to apply operating pressure to the respective devices. The control valves being reponsive to four electro-hydraulic pilot valves, each of which is controlled by four nominally identical electrical input signals. The control system includes means for monitoring the electrical input signals and the operating pressures, and for isolating or rendering inoperative parts of the system in response to several combinations of malfunction indication.

14 Claims, 8 Drawing Figures

Figure 1:
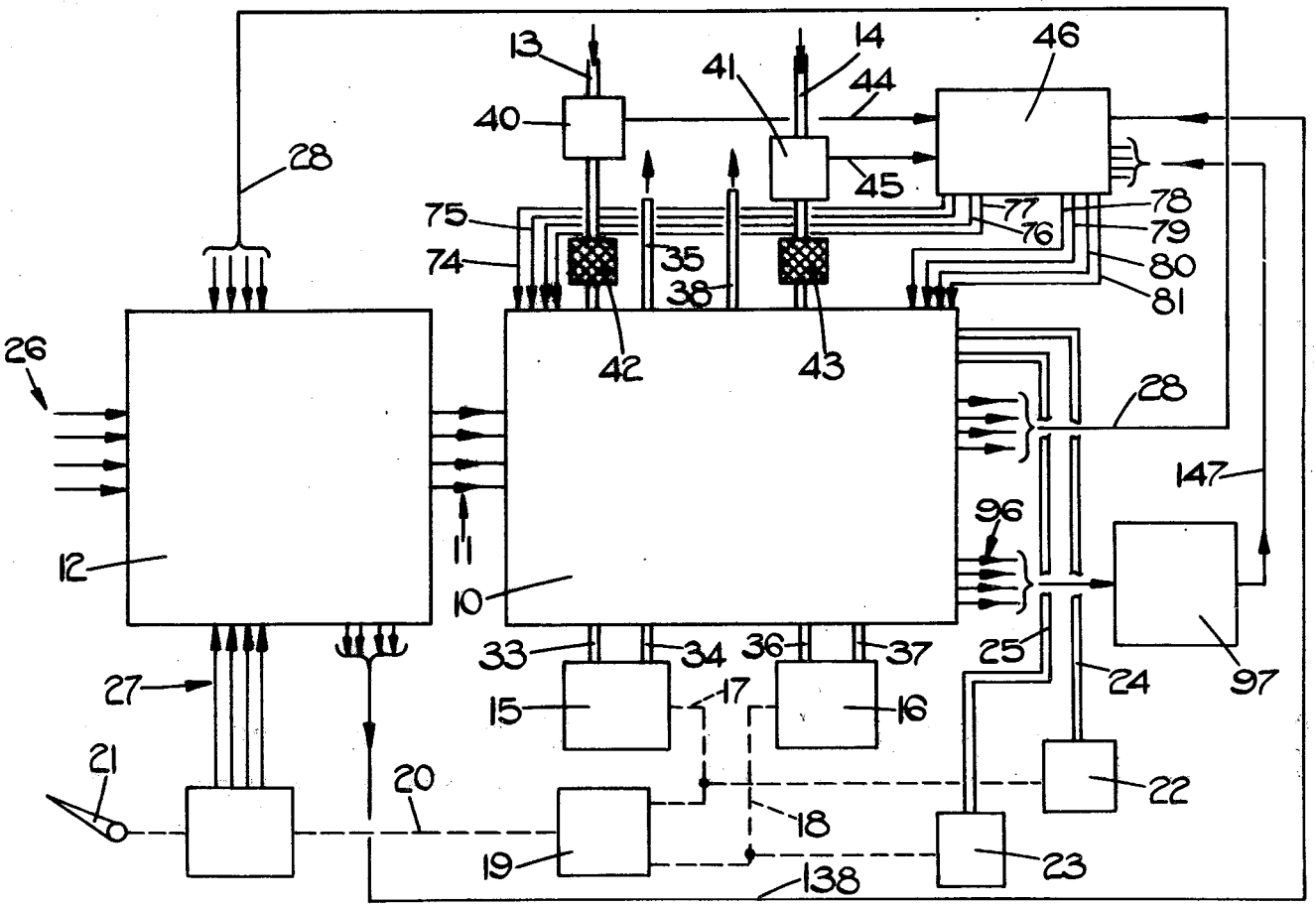

| | 150 & 151 | 152 & 153 | 154 & 155 | 156 & 157 |
|---|---|---|---|---|
| (i) | (z) | (z) | (z) | (z) |
| (ii) | (a) | (b) | (c) | (d) |
| (iii) | (b). ($P_2$) | (a). ($P_2$) | (d). ($P_1$) | (c). ($P_1$) |
| (iv) | (n) | (n) | (n) | (n) |

CONTROL SYSTEM FOR A FLUID PRESSURE OPERATED ACTUATOR ARRANGEMENT

This invention relates to a control system for a fluid pressure operated actuator arrangement of the kind in which a pair of actuator devices are drivingly connected to a single output element.

According to the invention a control system for a fluid pressure operated actuator arrangement of the foregoing kind comprises:

(a) first and second control valves having respective inlets, respective pairs of outlets and respective control members, said control members being interconnected for movement in unison, (b) first, second, third and fourth actuating means responsive to control pressures at respective ones of a first group of four control ports for urging said control members in unison in a first direction, and responsive to control pressures at respective ones of a second group of four control ports for urging said control members in unison in a second direction, movement of said control members in said first direction interconnecting the respective inlets with one outlet in the respective pairs thereof and movement of the control member in the second direction interconnecting the respective inlets with the other outlet in the respective pairs thereof, (c) means for generating four nominally-equal electrical control signals, (d) first valve means, responsive to each of said electrical control signals, for selectively applying said control pressures to respective ones of said first group of control ports or to respective ones of said second group of control ports, (e) first detector means, responsive to a variation of any of said electrical control signals by more than a predetermined amount from a desired value, for generating first electrical indicating signals which are respectively indicative of a control signal which has thus varied, (f) second detector means, responsive to malfunction of respective ones of said valve means, for generating second electrical indicating signals, (g) means for preventing the application to said valve means of any of said control signals indicated by said first indicating signals, (h) four shut-off means, responsive to selected ones of said second electrical indicating signals, for preventing a malfunctioning one of said valve means from applying a control pressure to corresponding ones of either said first group or said second group of control ports, said shut-off means also being responsive to said first electrical indicating signal for preventing control pressures from being applied to any of said control ports.

In a preferred embodiment the control system includes means for supplying a fluid operating pressure, said control pressures being derived from said operating pressure by said valve means, and in which said shut-off means comprises four valve devices responsive to respective electrical operating signals for isolating respective ones of said valve means from said operating pressure.

In a further preferred embodiment the operating pressure supply means comprises first and second fluid pressure inlets, the control pressures applied by a first two of said valve means being derived from the pressures at said first inlet, and the control pressures applied by a second two of said valve means being derived from the pressures at said second inlet.

Another preferred embodiment includes first and second means, respectively responsive to variations beyond predetermined limits of the pressures at said first and second inlets, for supplying fourth and fifth electrical indicating signals, and said shut-off means comprises four logic means responsive to combinations of said first, second fourth and fifth indicating signals for supplying said electrical operating signals to said valve devices.

Figure 2:
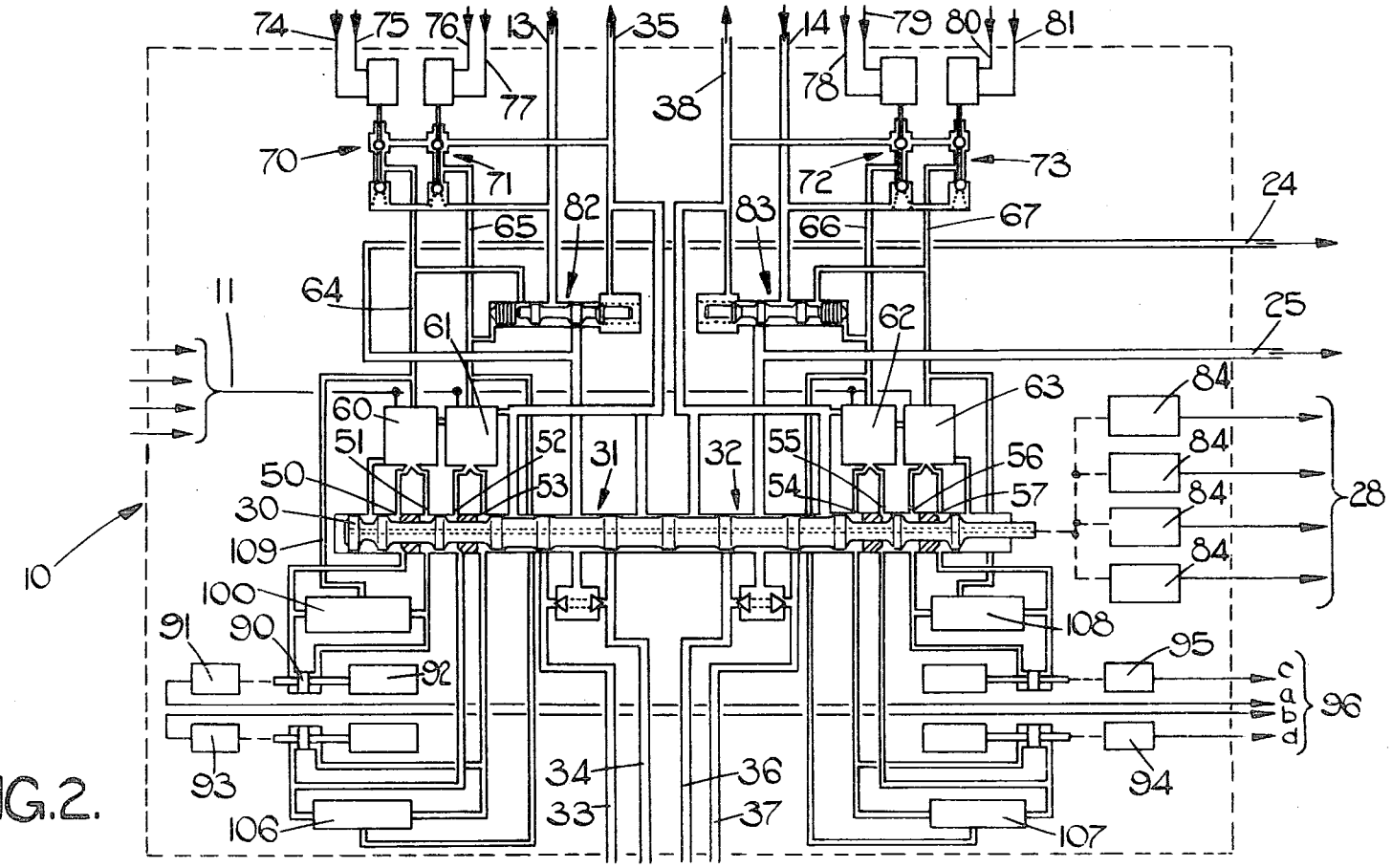
Figure 3:
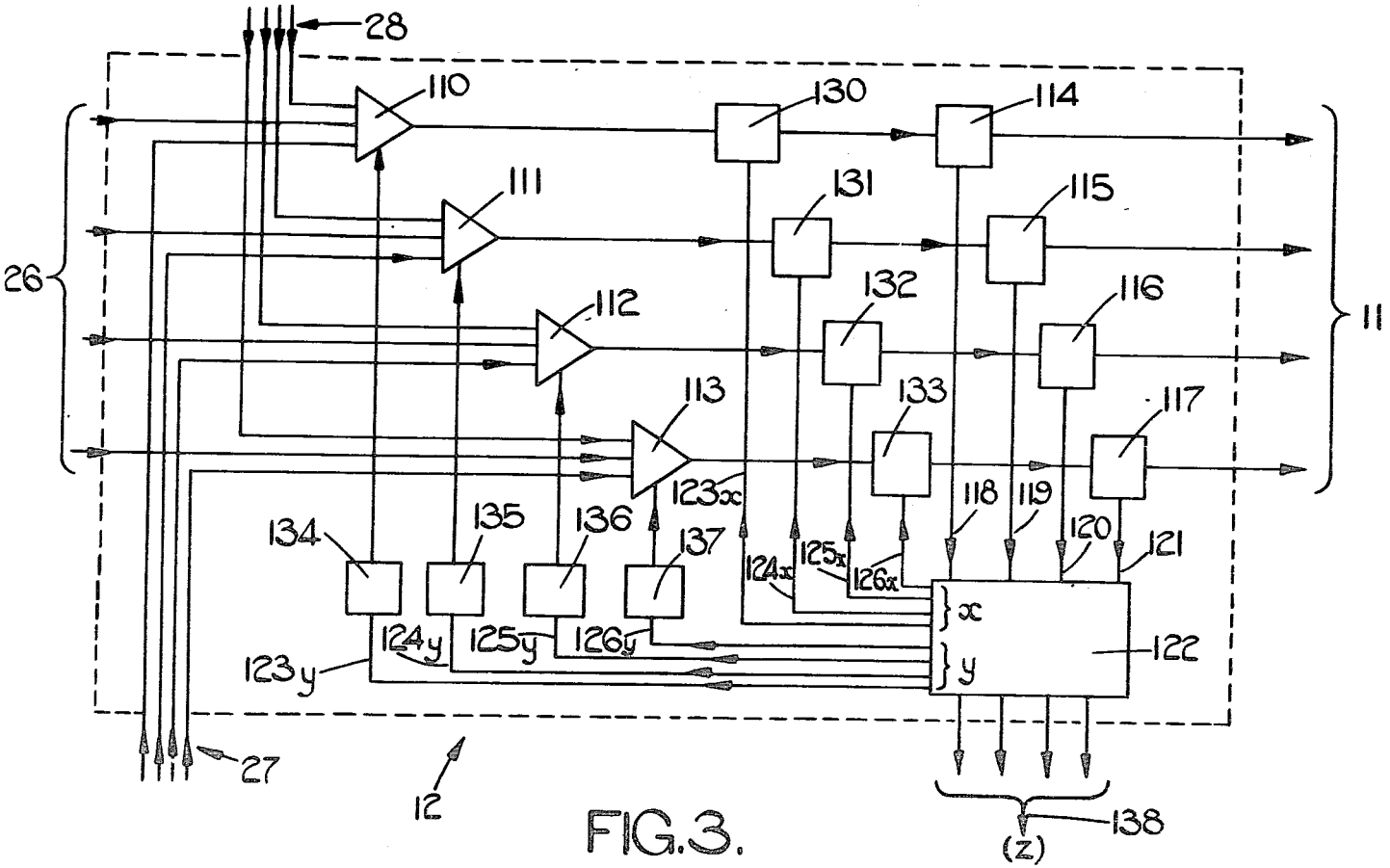
Figure 4:
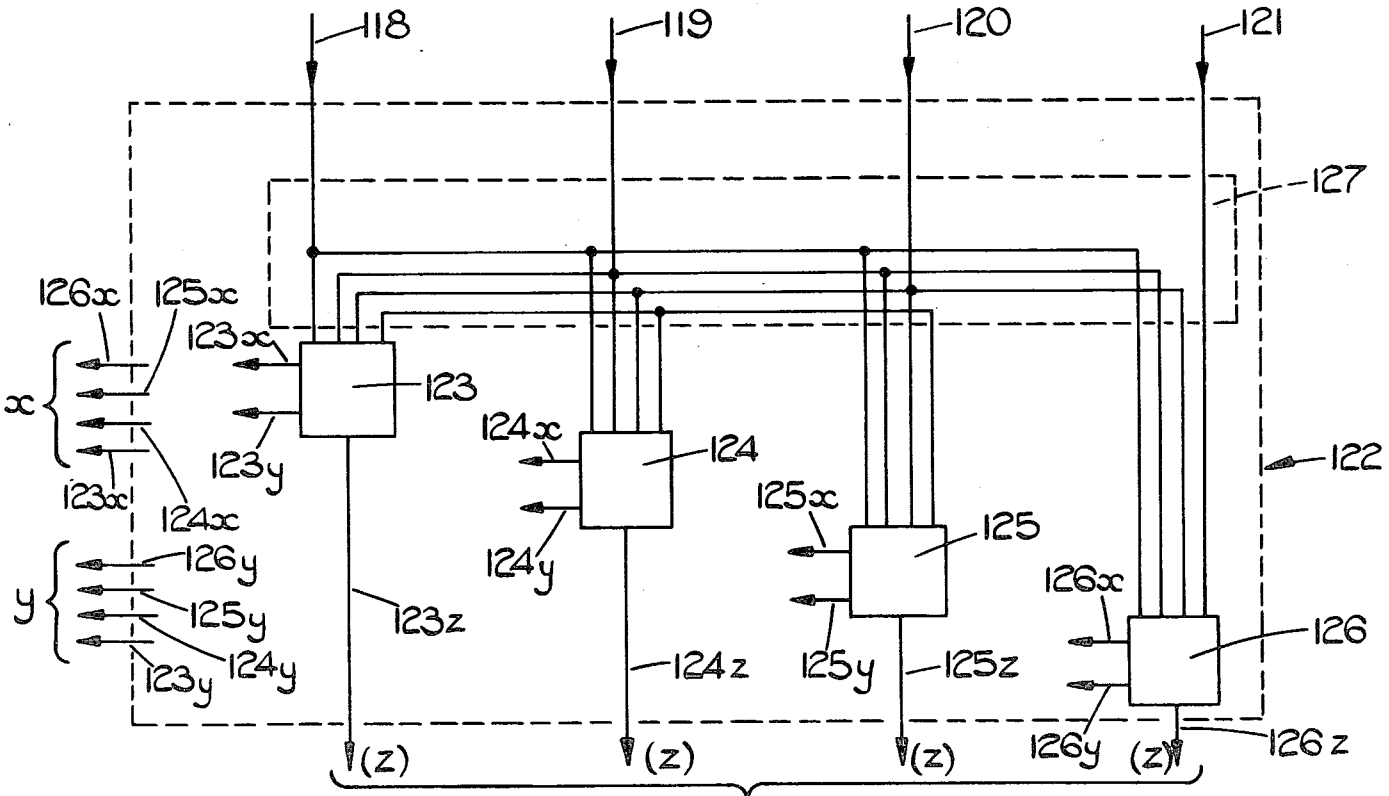
Figure 5:
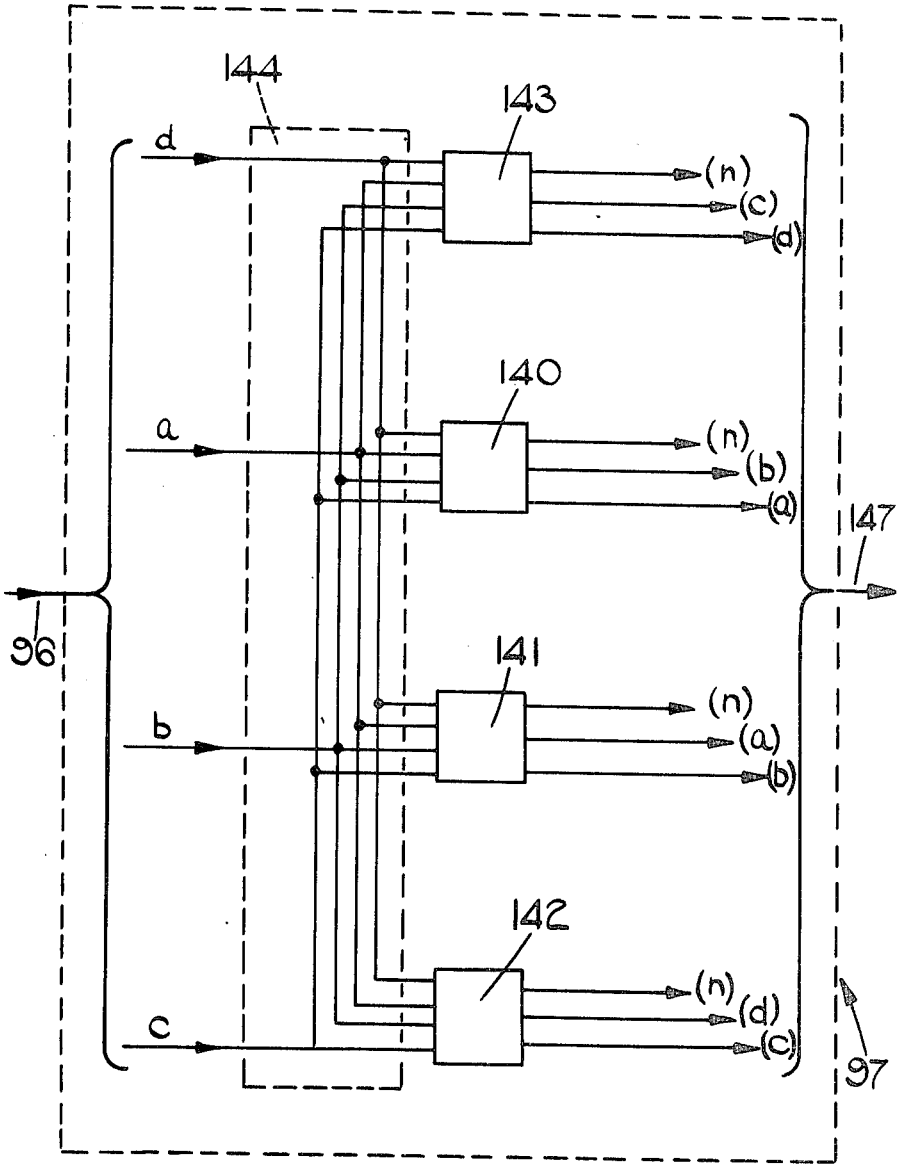
Figure 6:
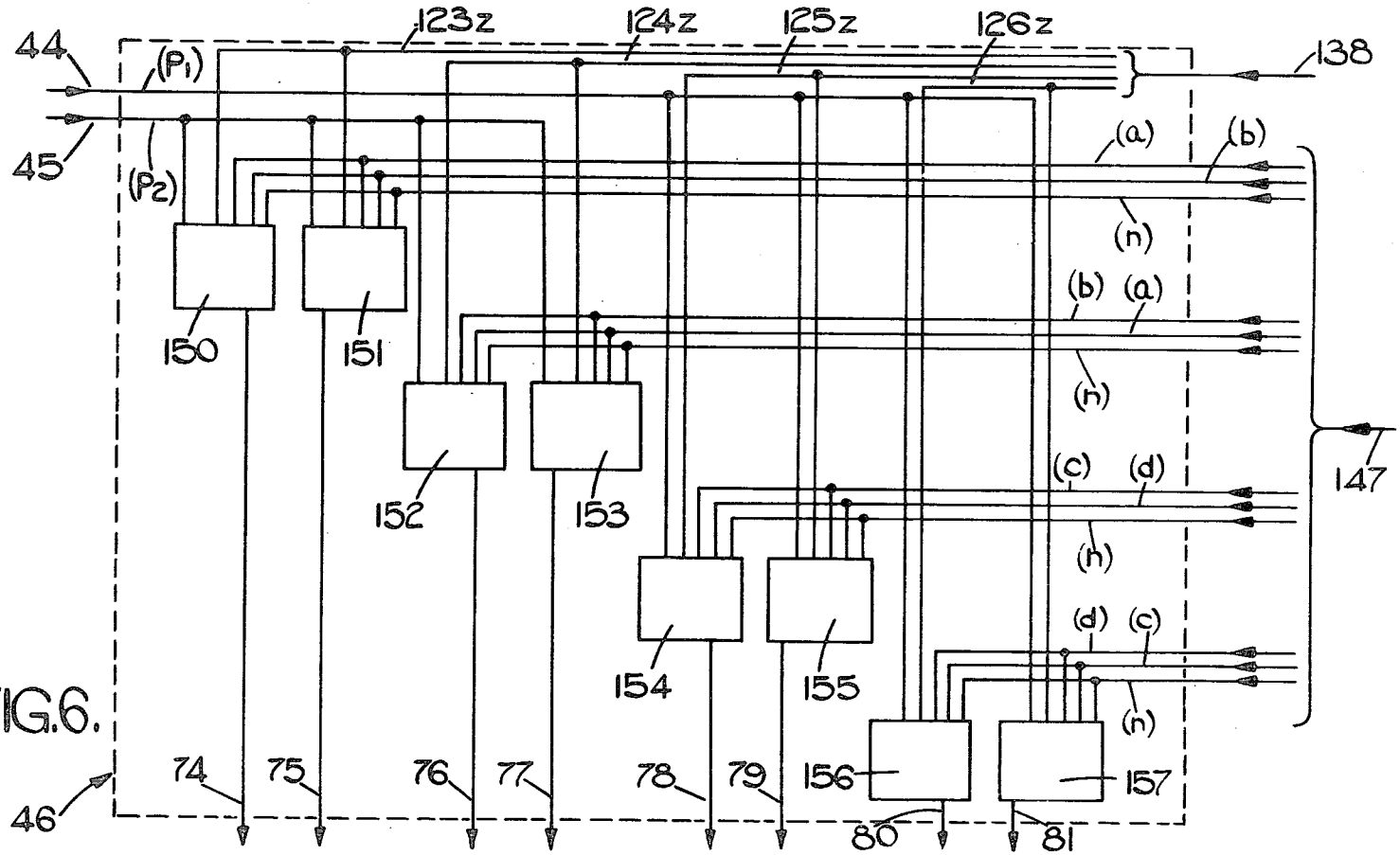
Figures 7, 8:
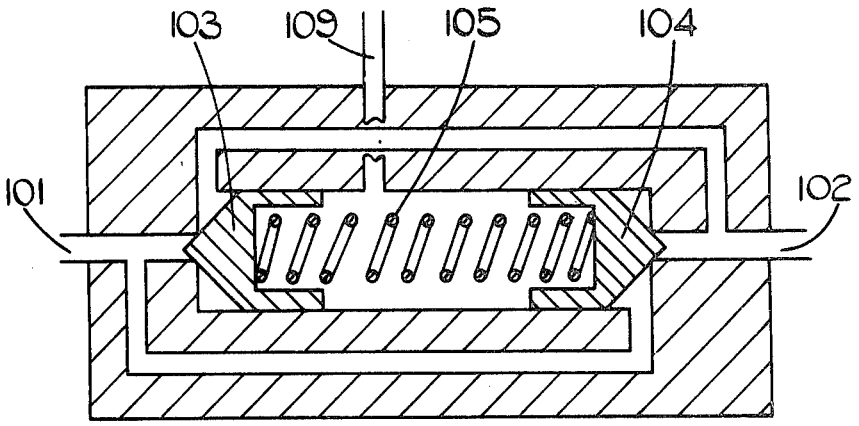

An embodiment of the invention will now be described by way of example and with reference to the accompanying drawings in which:

FIG. 1 shows a block diagram of a fluid pressure operated actuator arrangement,

FIG. 2 shows, diagrammatically, an electro-hydraulic control forming part of the arrangement of FIG. 1, FIG. 3 is a block diagram of an electrical control circuit forming part of the arrangement of FIG. 1, FIG. 4 is a block diagram of a discrimator circuit forming part of the control circuit of FIG. 3, FIG. 5 is a block diagram of a further discrimator circuit forming part of the arrangement of FIG. 1, FIG. 6 is a block diagram of a logic switching circuit forming part of the arrangement of FIG. 1, FIG. 7 is a detail of a by-pass valve arrangement forming part of the electro-hydraulic control of FIG. 2, and FIG. 8 is a table of the operating conditions of the logic switching circuit of FIG. 6.

The actuator arrangement of FIG. 1 has an electrohydraulic control system 10 responsive to electrical signals on four lines 11 from an electrical control circuit 12. The control system 10 is responsive to signals on lines 11 to control the application of hydraulic pressures on lines 13, 14 to respective hydraulic motors 15, 16. The output shafts 17, 18 of the respective motors 15 and 16 are connected to a differential gear 19 whose output shaft 20 is connected to a control surface 21 of an aircraft. Associated with the output shafts 17, 18 are respective brake devices 22, 23, both of which are biased so as to restrain the respective shafts 17, 18 against rotation. Brake devices 22, 23 are rendered inoperative by pressures on respective lines 24, 25.

The electrical control circuit 12 is responsive to input signals on four lines 26, to position feedback signals on lines 27 from the shaft 20, and to feedback signals, derived in a manner later to be described from the electro-hydraulic control system 10, on lines 28.

The electro-hydraulic control system 10 is shown in more detail in FIG. 2 and includes a spool control element 30 which is arranged to provide first and second control valves 31, 32. Valve 31 is operable to connect a selected one of a pair of passages 33, 34 to the pressure line 13 and to connect the other of these passages to a return line 35. Valve 32 is operable to connect a selected one of a pair of passages 36, 37 to the pressure line 14 and to connect the other of these passages to a return line 38. Passages 33, 34 and passages 36, 37 communicate with the respective motors 15, 16.

Pressure lines 13, 14 are provided with respective pressure transducers 40, 41 and also with respective filter units 42, 43. Electrical output signals from the transducers 40, 41 are supplied via respective lines 44, 45 to a monitoring logic circuit 46, later to be described in detail with reference to FIG. 6.

The spool control element 30 has a first actuating means in the form of a pair of lands which are responsive to control pressures at respective ports 50, 51 to urge the element 30 respectively leftward and rightward as seen in FIG. 2. The control element 30 has similar second actuating means responsive to control pressures at respective ones of a pair of ports 52, 53; a similar third actuating means responsive to pressures at respective ones of a pair of ports 54, 55 and a similar fourth actuating means responsive to control pressures at respective ones of a pair of ports 56, 57. Control pressures at any one of the ports 50, 52, 54 or 56 will urge the element 30 leftward to interconnect pressure line 13 and passage 33 and interconnect pressure line 14 and passage 36 and thereby rotate the motors 15, 16 in a first direction.

Control pressures applied to any of ports 51, 53, 55 or 57 will urge the element 30 rightwards to interconnect pressure line 13 and passage 34 and interconnect pressure line 14 and passage 37, and thereby urge the motors 15, 16 in a second direction.

Control pressures are selectively applied to ports 50, 51 by means of an electro-hydraulic valve 60 of a known type, and having four identical energising windings connected to respective ones of the lines 11. The valve 60 is responsive to signals on any one of its windings to apply control pressures to ports 50, 51 selectively.

Three further electro-hydraulic servo valves 61, 62, 63 are identical with the valve 60 and are respectively operable to apply control pressures to ports 52, 53, ports 54, 55 and ports 56, 57.

Valves 60, 61, 62 and 63 derive the control pressures from the pressures in respective lines 64, 65, 66 and 67. Pressure is supplied to lines 64, 65 from the pressure line 13 via respective solenoid valves 70, 71. Pressure is supplied to lines 66, 67 from the pressure line 14 via respective solenoid valves 72, 73. Solenoid valve 70 is energisable by electric signals on either one of a pair of lines 74, 75. Solenoid valves 71, 72 and 73 are similarly respectively energisable by signals on either one of respective pairs of lines 76, 77, pairs of lines 78, 79 and pairs of lines 80, 81. The signals on lines 74, 75, 76, 77, 78, 79, 80, 81 are supplied, in a manner to be described, from the monitoring logic circuit 46.

A shut-off valve 82 is biased by a spring to a position in which it isolates control valve 31 from the pressure line 13 and is urged against this spring by a pressure in either one of lines 64 or 65. A similar shut-off valve 83 is biased by a spring towards a position in which it isolates control valve 32 from the pressure line 14 and is urged against this spring by the pressure in either one of lines 66 or 67.

Line 24 to the brake device 22 is connected to the pressure line 13 via the shut-off valve 82, so that if the pressure is removed from line 13, or if both of the solenoid valves 70, 71 are shut, pressure is removed from the line 24 and the brake device 22 operates to arrest the output shaft 17 of motor 15. Line 25 to the brake device 23 is connected to the pressure line 14 via the shut-off valve 83, so that if the pressure is removed from line 14, or if both the solenoid valves 72, 73 are shut, the brake device 23 operates to arrest the output shaft 18 of motor 16.

It will be appreciated that control valves 31, 32 will always operate in unison by virtue of their being part of a single control element 30. Four linear position transducers 84 are responsive to the position of the control element 30 to provide the feedback signals on respective ones of the lines 28.

The pressures at the respective control ports 50, 51 are applied to opposite sides of a piston actuator 90 which is coupled to a further linear position transducer 91. The piston actuator 90 is urged towards a central position by a spring box 92 of a known type. Transducer 91 is thereby responsive to a pressure difference between control ports 50, 51 to provide an electrical output signal. Three further linear position transducers 93, 94, 95 are similarly responsive to the differential pressures at ports 52, 53, ports 54, 55 and ports 56, 57. Transducers 91, 93, 94, 95 provide electrical output signals on respective ones of lines 96 to a discriminator circuit 97 later to be described in detail with reference to FIG. 5.

Connected across the ports 50, 51 is a by-pass valve 100, which is shown in more detail in FIG. 7. The by-pass valve 100 has two connections 101, 102, which communicate with the respective ports 50, 51, and a third connection 109 which communicates with the line 64. A control element 103 is movable by the pressure in connection 101 to allow the latter to communicate with connection 102. A further control element 104 is responsive to the pressure in connection 102 to allow the latter to communicate with connection 101. Control elements 103, 104 are biased to shut-off their respective connections 101, 102 by a single light spring 105 and the pressures at which the aforesaid intercommunication occurs, are dependent on the pressure in connection 109. When solenoid valve 70 shuts, connection 109 communicates with the return line 35, and the valve 100 will then by-pass at a relatively small pressure difference. Identical by-pass valves 106, 107, 108 are connected across the respective ports 52, 53 ports 54, 55 and ports 56, 57.

As shown in FIG. 3 the electrical control circuit 12 includes four amplifiers 110, 111, 112, 113 which are responsive to the input control signals on respective ones of lines 26. Amplifiers 110, 111, 112, 113 are also responsive, by means of signals on respective ones of lines 27, to the position of the shaft 20 and control surface 21, and are also responsive to the position of the spool control element 30, by means of the feedback signals on respective ones of the lines 28. Amplifiers 110, 111, 112, 113 are operable to provide the electrical control signals on respective ones of the lines 11 to the electro-hydraulic control system 10. Current sensors 114, 115, 116, 117 are responsive to the currents in respective ones of the lines 11 to provide signals on respective lines 118, 119, 120, 121 to a discriminator arrangement 122 which is shown in more detail in FIG. 4.

As shown in FIG. 4 each of the lines 118, 119, 120, 121 is connected to provide input signals to each of four discriminator circuits 123, 124, 125, 126. Though in the diagrammatic representation of FIG. 4 these connections are shown as being made directly, the discriminator arrangement 122 in fact includes a de-coupling device 127 which is effective to isolate each of the lines 118, 119, 120, 121 from all of the others.

Discriminator circuits 123, 124, 125, and 126 are thus each responsive to four input signals and are respectively operable to determine whether the signals on respective lines 118, 119, 120 and 121 differ by more than a predetermined amount from the average of all four input signals, and to provide an indication of malfunction should this occur. Each of the circuits 123, 124, 125 and 126 includes memory means for recording whether any such malfunction has been detected by that circuit, or by any other of the discriminator circuits. Thus, if such a malfunction is detected by any of the discriminator circuits, that circuit, and all other circuits, will be aware of whether this is the first, second or third such malfunction detected by any of these circuits.

For example, if such a malfunction is detected by circuit 123, and is also the first malfunction detected by any of the circuits 123, 124, 125, 126 circuit 123 provides an output signal on a line 123*x*. The circuit 123 provides an output signal on a line 123*y* in the event of a second malfunction being detected by any of the circuits of the discriminator arrangement as a whole. Circuit 123 also provides an output signal on a line 123*z* in the event that a third malfunction is detected by any of the discriminator circuits in the discriminator arrangement as a whole.

Similarly, circuits 124, 125 and 126 are effective to detect differences, beyond a predetermined amount, between the aforesaid average and the signals on respective lines 119, 120, 121 and to generate signals on the respective lines 124*x*, 125*x*, 126*x* in response to these differences. Circuits 124, 125 and 126 also generate signals on their respective y and z lines in response to second and third malfunctions occurring in the discriminator circuit 122 as a whole. Signals on the x lines are supplied to respective devices 130, 131, 132 133 in the electrical control circuit 12. Device 130 is responsive to a signal on line 124*x* to prevent a current signal from being applied on the associated one of the lines 11 to electro-hydraulic control valves. Devices 131, 132, 133 are similarly responsive to signals on the respective lines 124*x*, 125*x*, 126*x* to cause corresponding devices 131, 132, 133 to prevent current from being applied to the respective windings of electro-hydraulic servo valves 60, 61, 62, 63. Preferably the devices 130, 131, 132, 133 will be such as to prevent operation of the respective amplifiers 110, 111, 112, 113.

Signals on the y lines from discriminator arrangement 122 are applied via respective delay circuits 134, 135, 136, 137 to corresponding ones of the amplifiers 110, 111, 112, 113, and are effective to raise the saturation levels of these amplifiers. Since y signals are present only when two electrical malfunctions have been detected by the discriminator arrangement 122, the appropriate x signals will have caused the amplifiers providing the malfunctioning signals to have been rendered inoperative, and after a delay imposed by the circuits 134, 135, 136, 137 the remaining two of the amplifiers only will have their saturation levels raised. Raising the saturation levels of the two remaining functional amplifiers ensures a sufficient excitation level for the electro-hydraulic valves 60, 61, 62, 63 even though only two of the windings of each of these valves will in these circumstances be energised.

The z signals are supplied on a group of lines 138 to the monitoring logic circuit 46.

The discriminator circuit 97 is shown diagrammatically in FIG. 5 and is, as previously described, responsive to signals on four lines 96 from respective ones of the linear transducers 91, 93, 94, 95, the signals from these transducers being respectively labelled a, b, c, d. The circuit 97 includes four discriminator circuit elements 140, 141, 142, 143 which are each connected to receive all the input signals a, b, c, d on the respective ones of lines 96. Though these connections are shown diagrammatically as being made directly, the circuit 97 includes a de-coupling device 144 so that each of the lines 96 is isolated from all of the others.

Discriminator circuit elements 140, 141, 142, 143 each have three output lines and are each responsive to the operation of all the others of the circuit elements, in a manner to be described.

Circuit element 140 provides an output signal (a) on one of its output lines when the input signal a differs from a mean value (as defined below) by more than a predetermined amount, and an output signal (b) on a second one of its output lines when the input signal b differs from this mean value by more than a predetermined amount.

Discriminator circuit element 141 provides output signals (b) and (a) on respective ones of its first and second output lines when input signals b and a respectively differ by more than predetermined amounts from the aforesaid mean value.

Circuit element 142 provides output signals (c) and (d) on its respective first and second output lines when input signals c and d respectively differ by more than predetermined amounts from the aforesaid mean value. Circuit element 143 provides output signals (d) and (c) on respective first and second output lines when input signals d and c respectively differ by more than predetermined amounts from the aforesaid mean value.

The mean value against which respective ones of the input signals are compared is the mean of all those of the input signals which have not given rise to an (a), (b), (c) or (d) output signal. Thus, if an input signal a varies from the mean value of signals a, b, c, d so as to give rise to an output signal (a), signal a will not subsequently be used in computing the mean value against which input signals a, b, c and d are to be compared.

The mean value will thus vary and the predetermined amount by which the input signals may differ from the mean value is set sufficiently high to ensure that when two of the solenoid valves 70, 71, 72, 73 have been shut, an unacceptable departure of one of the remaining two of the input signals on lines 96 will cause the circuit elements 140, 141, 142, 143 to provide a "third hydraulic failure" indication. This indication appears as a signal on the third output line of each of the discriminator circuit elements and is designated (n) in the drawings.

Output lines from the discriminator circuit elements 140, 141 142 are connected as a group of twelve lines 147 to the monitoring logic circuit 46.

As shown in FIG. 6 the monitoring logic circuit 46 includes a first pair of logic units 150, 151, a second pair of logic units 152, 153, a third pair of logic units 154, 155 and a fourth pair of logic units 156, 157. Logic units 154, 155, 156, 157 are responsive to a signal on a line 44 from the transducer 40 in the pressure supply line 13, this signal indicating that the pressure in line 13 has failed and being designated (P1) in the drawing. Logic units 150, 151, 152, 153 responsive to a signal (P2) on line 45 from the transducer 41 indicating that the pressure in supply line 14 has failed.

Logic units 150, 151 are responsive to "third electrical failure" signals on line 123*z* from discriminator arrangement 122 (FIG. 4). Logic unit pair 152, 153, pair 154, 155 and pair 156, 157 are respectively responsive to "third electrical failure" signals on lines 124*z*, 125*z* and 126*z* from discriminator arrangement 122. The third electrical failure condition is designated (z) in the logic unit operation table shown in FIG. 8.

Logic units 150, 151 are responsive to the output signals from discriminator element 140 in circuit 97. Logic units 152, 153; 154, 155 and 156, 157 are respectively responsive to the output signals from discriminator circuit elements 141, 142 and 143.

Logic units 150, 151 are responsive to the combinations of conditions indicated in FIG. 8 to provide signals on lines 74, 75 to the respective windings of solenoid valve 70, signals on either one of these windings being effective to shut valve 70. Logic units 152, 153 are responsive to conditions shown in FIG. 8 to provide signals on lines 76, 77, either of which will shut solenoid valve 71. Logic units 154,155 are responsive to conditions shown in table 8 to provide signals on respective lines 78, 79, either of which will shut solenoid valve 72. Finally, logic units 156, 157 are responsive to the appropriate conditions in table 8 to provide signals on lines 80, 81 to cause solenoid valve 73 to shut.

In normal operation, four nominally-identical input signals are applied on the lines 26 to the electrical control circuit 12, which in turn provides signals on the four lines 11 to all of the electro-hydraulic servo valves 60, 61, 62, 63 in the control system 10. The electro-hydraulic servo valves 60, 61, 62, 63 operate in unison to provide control pressures to the actuating means of the control element 30, the control pressures urging the element 30 in a first direction being normally equal to the control pressures urging the element 30 in a second direction. Solenoid valves 70, 71, 72, 73 are normally open and the control pressures supplied by valves 60, 61 are derived from the input pressure line 13 via respective lines 64, 65 and the control pressures supplied by valves 62, 63 are derived from the input pressure line 14 via respective lines 66, 67.

Shut-off valves 82, 83 are therefore urged open against their springs and movement of the control element 30 causes valves 31, 32 to apply pressures to selected ones of the passages 33, 34 and passages 36, 37, and to connect the others of these passages to the return lines. Pressures are also applied via lines 24, 25 to the respective brake devices 22, 23, releasing the output shafts 17, 18 respectively of the motors 15, 16 and these motors are thus free to rotate in directions selected by the valves 31, 32.

Valve position feedback signals on lines 28 to the electrical control circuit 12 effectively provide rate signals for the motors 15, 16. Position feedback signals on lines 27 from the output shaft 20 of the differential gear 19 cause valves 31, 32 to be returned to their shut positions when the position of the aircraft control surface 21 corresponds to position selection signals on lines 26.

As previously described, in the event that one of the current signals on the lines 11 to the control system 10 is indicative of a malfunction, the one of the amplifiers 110, 111, 112, 113 providing that signal is rendered inoperative. A second malfunction renders the corresponding amplifier inoperative and raises the saturation levels of the remaining amplifiers. A third malfunction provides a "z" signal on each of the four lines 138 to the logic circuit 46.

In the event that the pressure in the supply line 13 falls below a predetermined level, the resultant drop in pressure in lines 64 and 65 will cause the shut-off valve 82 to close. Independent of operation of valves 60, 61, no operating pressure will then be supplied to motor 15 via either of the passages 34, 35 and, moreover, the brake device 22 will be operated to arrest the output shaft 17 of motor 15. The control surface 21 nevertheless continues to be driven by motor 16 via the differential gear 19, the braked shaft 17 providing a reaction for the motor 16. Similarly, motor 16 is rendered inoperative by a failure of pressure on the input line 14.

If the pressures on input lines 13, 14 remain acceptable but the control pressure differences at the ports 51, 52; 52, 53; 54, 55 and 56, 57, detected by the respective transducers 91, 93, 94, 95 vary unacceptably, as previously described, either due to malfunction of corresponding ones of valves 60, 61, 62, 63, or as a result of blockage in some part of the system, the discriminator circuit 97 provides output signals to the logic circuit 46 as previously described.

A third electrical failure (z) causes all the solenoid valves 70, 71, 72, 73 to be shut. Shut-off valves 82, 83 shut, the brake devices 22, 23 operate and the control surface 21 is locked in the position in which the third electrical malfunction occurred.

In the event that a signal (a), (b), (c) or (d) appears on any one of the first output lines of the discriminator elements 140, 141, 142, 143 the corresponding one of the solenoids 70, 71, 72, 73 is shut so as to remove the control pressure providing the defect signal, as indicated at line (ii) in FIG. 8.

It is required that the system shall continue to function with signals on two of the lines 11 from the electrical control circuit and also with two of the electro-hydraulic servo valves 60, 61, 62, 63 operational, but that movement of the control surface 21 shall be arrested if more than two electrical lanes or more than two hydraulic lenses are defective. To this end the logic units are responsive to the conditions shown in line (iii) of FIG. 8. For example, the presence of a signal (b), indicating that electro-hydraulic valve 61 has failed, together with signal (P2) indicating that the pressure supply on line 14 has also failed, would leave electro-hydraulic valve 60 the only one controlling the position of the element 30, and this is an unacceptable condition. Logic units 150 and 151 respond to this condition, therefore, to shut solenoid valve 70, whereupon shut-off valve 82 also closes and the brake device 22 is applied, "freezing" the control surface 21 in position. Logic units 152, 153; 154, 155 and 156, 157 are similarly responsive to failure of a hydraulic lane supplied from the same one of the pressure lines 13, 14, together with failure of the pressure on the other of the lines 13, 14. The system as a whole will thus continue to operate with two defective electric input channels, two defective hydraulic lanes and one hydraulic supply pressure failure, unless any of the conditions indicated at (i), (ii) or (iv) in FIG. 8 are present, in which case the system shuts down and locks the control surface 21 in position.

Thus, each of the electrical input control signals is separately monitored, and increase or decrease of any of these control signals by more than a predetermined amount from a desired value which is represented by the mean of these signals, results in the deviant signal being removed from its controlling function.

In known electro-hydraulic actuator arrangements as for example that shown in British patent No. 784,088, in which each of a plurality of valves has a plurality of electrical windings, the only electrical malfunction which is catered for is that of total loss of any of the electrical signals, and no correction is provided for unacceptable increase or decrease in the electrical input signal levels.

In the present invention, moreover, the fact that the saturation levels are raised only on the two of the amplifiers 110, 111, 112, 113 which remain in operation after two of these amplifiers have been shut down, ensures that the energising coils of the valves 60, 61, 62, 63 are not overdriven in normal use, as would be necessary in the arrangement shown in British Patent No. 784,088 in order to ensure that the valves in that arrangement were sufficiently energised after shut down of one or more of the electrical channels.

Known electro-hydraulic actuator systems, as for example that shown in U.S. Pat. No. 3,338,138 provide for system redundancy and for failure indication, these known systems are believed not to provide an arrangement which is responsive to combinations of malfunction so as to ensure system shut down in the event of:

(a) three electrical input malfunctions, or (b) malfunction of one input pressure together with malfunction of control valves responsive to the other input pressure, or (c) malfunction of both input pressures, or (d) malfunction of any three control valves, but which remains operational in all other conditions of malfunction.

I claim:

1. A control system for a fluid pressure operated actuator arrangement which has a pair of actuator devices drivingly connected to a single output element, said control system comprising:

(a) first and second control valves having respective inlets, respective pairs of outlets and respective control members, said control members being interconnected for movement in unison, (b) first, second, third and fourth actuating means responsive to control pressures at respective ones of a first group of four control ports for urging said control members in unison in a first direction, and responsive to control pressures at respective ones of a second group of four control ports for urging said control members in unison in a second direction, movement of said control members in said first direction interconnecting the respective inlets with one outlet in the respective pairs thereof and movement of the control member in the second direction interconnecting the respective inlets with the other outlet in the respective pairs thereof, (c) means for generating four nominally-equal electrical control signals, (d) four valve means, all of said valve means being responsive to each of said electrical control signals, for selectively applying said control pressure to respective ones of said first group of control ports or to respective ones of said second group of control ports, (e) first detector means, responsive to a variation of any of said electrical control signals by more than a predetermined amount from a desired value, for generating first electrical indicating signals which are respectively indicative of a control signal which has thus varied, (f) second detector means, responsive to malfunction of respective ones of said valve means, for generating second electrical indicating signals, (g) means for preventing the application to said valve means of any of said control signals indicated by said first indicating signals, (h) four shut-off means, responsive to selected ones of said second electrical indicating signals, for preventing a malfunctioning one of said valve means from applying a control pressure to corresponding ones of either said first group or said second group of control ports.

2. A control system as claimed in claim 1 in which said first detector means comprises means for sensing the magnitudes of respective ones of the electrical control signals supplied by said generating means, means for comparing each of said control signal magnitudes with the mean of all of said magnitudes and means for generating said first electrical indicating signals if any of said magnitudes differs from said mean by more than a predetermined amount.

3. A control system as claimed in claim 2 in which said first detector means includes means, responsive to a difference of more than a predetermined amount between any three of said control signal magnitudes and said mean, for generating a third electrical indicating signal, said shut-off means also being responsive to said third indicating signal.

4. A control system as claimed in claim 2 in which said electrical signal generating means comprises four electrical amplifiers for supplying respective ones of said control signals, and said first detector means includes means, responsive to a difference of more than a predetermined amount between each of two of said control signal magnitudes and said mean, for raising the saturation levels of the amplifiers which supply the other two of said control signals.

5. A control system as claimed in claim 1 in which said second detector means includes transducer means, responsive to a difference between the pressures at respective ones of said first group of control ports and the pressures at corresponding ones of said second group of control ports, for providing four third electrical indicating signals whose magnitudes are functions of respective ones of said pressure differences, and means, responsive to a difference of more than a predetermined amount between the magnitude of any one of said third indicating signal and a mean value derived from said third indicating signal magnitudes, for generating a second electrical signal indicative of said difference in one of the third signals.

6. A control system as claimed in claim 5 in which said second detector means includes means, responsive to a difference of more than a predetermined amount between the magnitudes of each of two of said third signals and said mean derived from said third signal magnitudes, for generating two of said second electrical signals respectively indicative of said two of the third signals.

7. A control system as claimed in claim 5 in which said second detector means comprises means, responsive to a difference of more than a predetermined amount between the magnitudes of each of three of said third signals and said mean derived from the third signal magnitudes, for generating a third of said second electrical signals.

8. A control system as claimed in claim 3 which includes means for supplying a fluid operating pressure, said control pressures being derived from said operating pressure by said valve means, and in which said shut-off means comprises four valve devices responsive to respective electrical operating signals for isolating respective ones of said valve means from said operating pressure.

9. A control system as claimed in claim 8 in which said operating pressure supply means comprises first and second fluid pressure inlets, the control pressures applied by a first two of said valve means being derived from the pressures at said first inlet, and the control pressures applied by a second two of said valve means being derived from the pressures at said second inlet.

10. A control system as claimed in claim 9 which includes first and second means, respectively responsive to variations beyond predetermined limits of the pressures at said first and second inlets, for supplying fourth and fifth electrical indicating signals, and said shut-off means comprises four logic means responsive to combinations of said, second, third fourth and fifth indicating signals for supplying said electrical operating signals to said valve devices.

11. A control system as claimed in claim 10 which includes pressure-operable valve means, responsive to a fall in the fluid pressures downstream of said valve devices, for isolating said first and second control valves from said first and second fluid pressure inlets.

12. A fluid pressure operated actuator arrangement comprising a control system as claimed in claim 1 in which said two actuator devices are responsive to fluid pressures at the outlets of respective ones of said control valves.

13. An arrangement as claimed in claim 12 which includes means responsive to the operating position of said output element for generating an electrical feedback signal, said electrical control generating means being responsive to said feedback signal.

14. An arrangement as claimed in claim 12 which includes means, responsive to the operating positions of the control members of said control valves, for generating a sixth electrical signal, said control signal generating means being responsive to said sixth electrical signal, whereby said sixth electrical signal can provide an indication of the rate of movement of said actuator devices.

* * * * *